US005138797A

United States Patent [19]

Sidén

[11] Patent Number: 5,138,797

[45] Date of Patent: Aug. 18, 1992

[54] GRINDING GUIDE ASSEMBLY FOR A HAND-HELD GRINDING MACHINE FOR BUTTONS OF A BUTTON DRILL BIT

[75] Inventor: Jan Sidén, Skelleftea, Sweden

[73] Assignee: Inovac AB, Skelleftea, Sweden

[21] Appl. No.: 526,940

[22] Filed: May 22, 1990

[30] Foreign Application Priority Data

May 24, 1989 [SE] Sweden ..... 8901846

[51] Int. Cl.[5] ..... B24B 7/00

[52] U.S. Cl. ..... 51/102; 51/241 G; 51/268

[58] Field of Search ..... 51/102, 98 R, 241 G, 51/268, 170 PT, 128, 206 A, 206 NF; 125/11.01, 11.04, 11.13, 11.14; 76/108.1, 108.2, DIG. 12, DIG. 11

[56] References Cited

U.S. PATENT DOCUMENTS 2,073,861 3/1937 Wolf ..... 51/170
4,504,178 3/1985 Seidenfaden ..... 51/102 X
4,611,438 9/1986 Siden ..... 51/206 R
4,977,709 12/1990 Siden ..... 51/206 R

FOREIGN PATENT DOCUMENTS 0662533 5/1963 Canada ..... 51/170 PT

*Primary Examiner*—M. Rachuba
*Attorney, Agent, or Firm*—Cushman, Darby & Cushman

[57] ABSTRACT

An arrangement in hand-held grinding machines intended for grinding the buttons of button drill-bits and provided with a driven spindle which carries a grinding disk. The grinding disk presents a profiled groove for shaping respective buttons of the bit to their intended tip profile. In order to enable buttons to be ground quickly and effectively with the aid of a hand-held grinding machine without needing to rotate the button to be ground about its own longitudinal axis, there is provided a spring-steel guide-spring which is mounted fixedly in relation to the grinding disk and which presents on both sides of the disk (4) obliquely and inwardly extending fingers which are intended to engage the button to be ground when the grinding disk is brought into engagement with the button.

6 Claims, 2 Drawing Sheets

GRINDING GUIDE ASSEMBLY FOR A HAND-HELD GRINDING MACHINE FOR BUTTONS OF A BUTTON DRILL BIT

BACKGROUND OF THE INVENTION

The present invention relates to an arrangement in hand-held grinding machines intended for grinding button drill-bits and comprising a driven spindle which has a grinding disk mounted thereon.

Because button bits are able to remove more material than chisel-edge bits or other straight cutting-edge bits, button bits have been used to a much greater extent in all types of rock drilling operations. Initially, button drill-bits were used as disposable products and were scrapped as soon as the buttons were completely worn down. One reason for scrapping the bits was because of the lack of suitable grinding equipment by means of which such drill bits could be resharpened or reshaped. Attempts were made to use high speed hand-held grinding machines provided with a simple grinding disk, with which the buttons of the stationary drill bit were machined in a punctiform manner. It was quickly discovered, however, that it was practically impossible to restore the buttons of the drill bit to their original, hemispherical tip-configuration with the use of such primitive grinding equipment, not least because of the considerable amount of time taken, and it was quickly realized that it was more viable economically to scrap the drill bits than to attempt to grind the buttons thereof with the aid of the grinding equipment available at that time.

As in the case of all other machines, grinding equipment intended for grinding button drill-bits has, however, been developed and improved considerably, and the most significant step in this development is considered to be the realization that the button to be ground should rotate about its own longitudinal axis. The second important step in this development is considered by many to be the configuration of the actual grinding disk itself, with the provision of a profiled groove which corresponds substantially to the hemispherical profiled shape of the button tips . The most effective button-bit grinding machines known at present also include such a grinding disk and a rotable holder or fixture intended for holding firmly the drill bit whose buttons are to be ground and by means of which the buttons of the drill bit can be adjusted to and fixated in a grinding position and rotated about their own longitudinal axis in said grinding position. The worn buttons of a button drill-bit can be restored to their original shape very quickly and effectively with the aid of these machines, even in those instances where it is necessary to remove material from around the button, this material being considerably softer than the material from which the button is made, e.g. cemented carbide material.

These modern grinding machines for grinding the buttons of button drill-bits are highly effective and demand a relatively high price, which prevents such machines from being used as standard ancillary equipment with transportable rock drilling equipment, but must normally be mounted statically at fixed locations so that button drill-bits which require sharpening can be sent to the machine and thereby provide effective and remunerative use of the modern grinding machines.

Because the use of button drill-bits has been increased in all kinds of rock drilling operation, and particularly in rock drilling operations which are not directly relatable to mining operations, there is an increasing desire and demand for a simple, but nevertheless effective grinding machine which can be used in the immediate location of a rock drilling unit out in the field for grinding the worn or damaged buttons of a button drill-bit to the intended tip-profile shape in a relatively quick and effective manner, preferably without needing to detach the drill bit from the drill equipment. Attempts have been made to fulfill this desideratum, by using conventional hand-held grinding machines equipped with grinding disks of the aforesaid kind, i.e. a grinding disk provided with a profiled groove having, in cross-section, longitudinally 1 the disk a substantially semi-circular shape. In order to be able to grind a button to its intended tip-profile shape, while being able to rotate the drilling machine around the button at the grinding point at the same time, it is necessary to hold the grinding disk centred on one single point in relation to the button. This cannot be achieved with a conventional hand-held grinding machine, and hence the aforesaid attempts to use conventional hand-held grinding machines have not been successful.

SUMMARY OF THE INVENTION

Accordingly, the object of the present invention is to provide a solution to the aforesaid problem and therewith enable the buttons of button drill-bits to be ground effectively and relatively quickly with a hand-held grinding machine, which may be driven pneumatically, hydraulically or electrically depending on the power source available at the site where the machine is used.

BRIEF DESCRIPTION OF THE DRAWINGS

The invention will now be described in more detail with reference to an exemplifying embodiment thereof and with reference to the accompanying drawings, in which.

DETAILED DESCRIPTION

Figure 1:
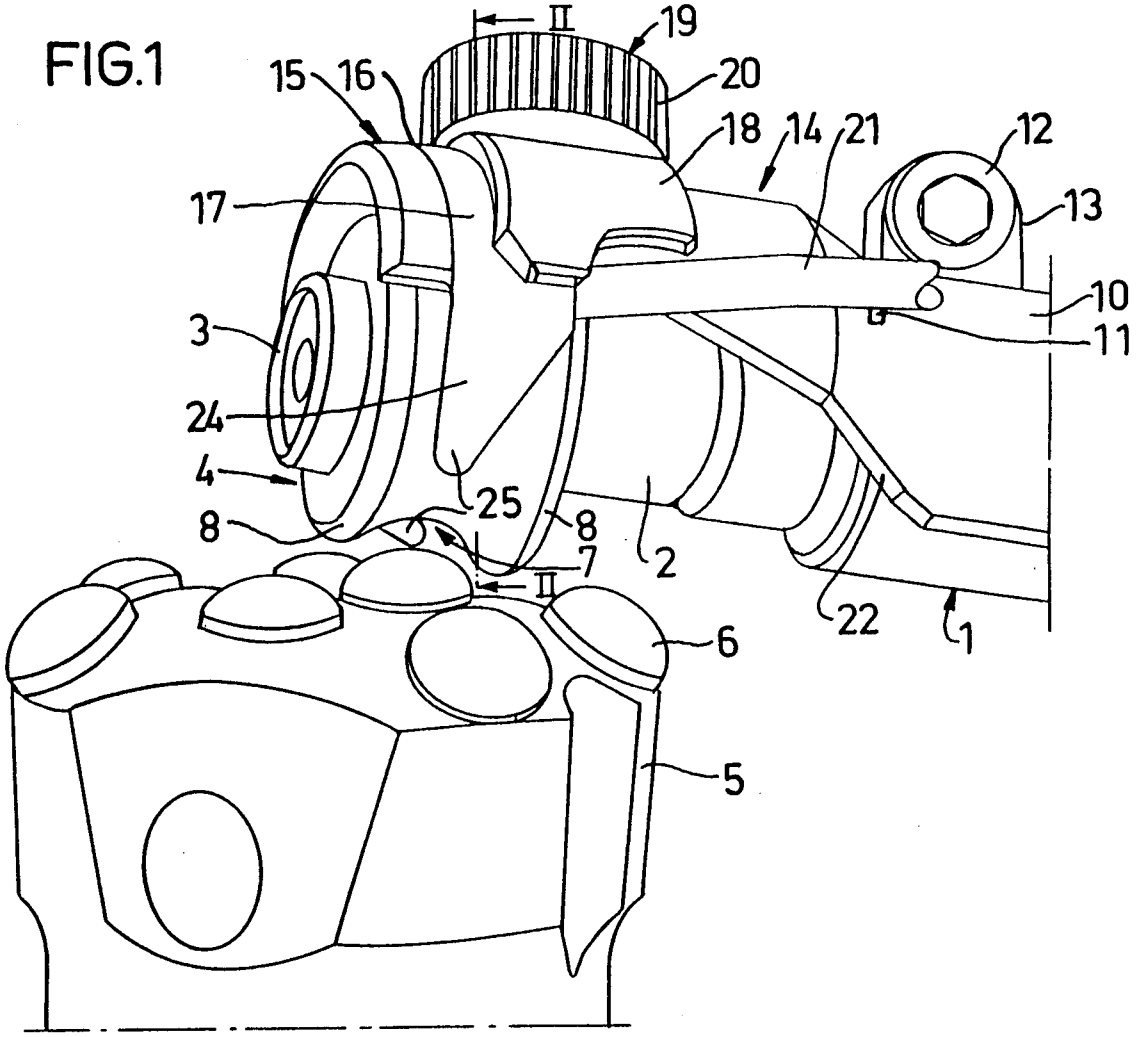
FIG. 1 is a perspective view of a hand-held grinding machine provided with the structural arrangement, provided in accordance with the principles of the present invention and shows the machine in a position in which the grinding disk of the machine is brought into engagement with a button of the drill bit.

In the drawings, the reference numeral 1 identifies generally a grinding machine which is intended to be held by hand and which can be driven pneumatically, hydraulically or electrically. Attached to the driven spindle 2 of the grinding machine is a grinding disk 4 which is locked immovably in relation to the spindle 2 by means of a locking screw 3 fitted with a washer. The grinding disk 4 is of a known kind intended for grinding the buttons 6 of a button drill-bit 5, the buttons being made of cemented carbide material or some corresponding material. The grinding disk includes a circumferentially extending profiled groove 7 which normally has a semicircular cross-sectional shape, or some other shape capable of imparting the intended tip profile to the button. The groove 7 is defined by circumferentially extending flange parts 8 which may be provided on their peripheral parts with a grinding-agent coating suitable for removing steel material from around the button 6, but may also be provided with the same grinding-agent coating as the profiled groove 7, i.e. a grinding-agent coating intended for grinding cemented carbide material or hard metal, e.g. a diamond-containing coating.

In accordance with the present invention, the grinding machine 1 has mounted thereon a sleeve 10 which is slotted along the upper side thereof (not visible in the drawing) and which may also be provided with a transverse slot 11. The sleeve 10 is firmly mounted on the machine 1 by clamping action engendered with the aid of a locking screw 12 or bolt joint in co-action with lugs 13 upstanding on both sides of the slot on the upper side of the sleeve. The sleeve 10 is also provided with or formed with an arched protective cover 14 which is raised in relation to the sleeve 10 and which extends forwards and completely over the grinding disk 4. Formed in the upper side 15 of the cover 14, opposite the grinding disk 4, is a guide groove 16 in which a guide spring 17 is arranged. The spring 7 is held positively and immovably in position in the groove 16 by means of a keeper or clamping device 18 and a locking screw 19 which can be screwed into the cover 14. The locking screw is preferably provided with a comfortably grippeable turning-head 20 of a relatively large diameter so as to provide the requisite lever arm for locking the guide spring via the keeper 18 without requiring the aid of a tool therefor.

The reference numeral 21 identifies a coolant channel for the supply of coolant to the grinding disk. In the case of the FIG. 1 embodiment, the channel 21 has the form of a tube positioned on the outside of the protective cover 14, although it will be understood that the requisite coolant channel or channels may also be configured in the wall of the cover and optionally in the wall 22 of the sleeve and discharged into one or more nozzle openings (not shown) extending obliquely downwards towards the grinding disk 4.

The guide spring 17, which may be made of spring steel or some other material of corresponding spring action and spring ability, includes an arcuate part 23 which is configured for positioning in the guide groove 16 and the width of which corresponds to the width of the groove and the extention of which coincides substantially with the extension of the groove, as illustrated in the drawings. The spring may also project slightly from both sides, but equally as long from the groove end. The spring 17 also includes fingers 24 which extend obliquely inwards from the ends of the arcuate part and each of which narrows in a direction towards its free end 25. The midway point of the two ends of respective fingers is located substantially in the rotational plane of the grinding disk through the deepest part of the profiled groove, the plane coinciding with the plane of the drawing in FIGS. 2 and 3 and in the non-activated state of the fingers, illustrated in FIG. 2. The fingers form therebetween a gap which is wider than the diameter of the button 6 to be ground. For this reason, the arrangement may, and should, include a plurality of guide springs 17 each having mutually different gap-widths between the ends 25 of their respective fingers, therewith enabling the same guide springs 17 to be used for several buttons whose diameters lie close to one another. This will limit the number of guide springs 17 required to cover all existing button diameters to four or five.

In the non-activated state of the guide spring, the ends 25 of the guide-spring fingers will also be located at a distance from the button 6 of the profiled groove. More specifically, in the non-activated state of the fingers, the ends 25 of said fingers shall be located closer to the peripheral parts of the grinding disk than to the groove bottom 26, so that they can be brought into engagement with the button 6 to be ground in the intended manner and thereby hold the grinding disk 4 centred in relation to the button 6 through co-action with the peripheral flange-parts 8 of the disk. Thus, when the grinding disk 4 is brought from the starting position illustrated in FIG. 2 into engagement with the button 6 to be ground, the ends 25 of the fingers will be brought into contact with the end surface 27 of the drill bit prior to the grinding disk 4 coming into contact with the respective button 6, and then guided by the end surface 27 in towards the button 6 at the same time as the angle a between the fingers 24 and the end surface 27 of the drill bit decreases, until the fingers 24 are in contact with the button 6. If, when reaching this position, the grinding disk 4 is still not in contact with the button, the fingers 24 will bend slightly inwards during the last stage of the application movement of the disk, as illustrated by broken line 28 in FIG. 3, or possibly outwards, depending upon the nature of the occurrent forces. As a result of the positive spring action of the fingers 24 and the possible inward or outward bending to which these fingers are subjected when bringing the grinding disk into engagement with a button 6 to be ground, the fingers 24 will subsequently attempt to straighten out, fully automatically, and return to their starting state. Also, provided that the grinding disk is held in abutment with the button, the fingers 24 will constantly be held in resilient abutment with the end surface 27 of the drill bit and therewith constantly maintain a grip around the button in the vicinity of its root, on a level with the end surface 27 of the drill bit, this grip being highly satisfactory for the purpose intended. The grinding disk 4 is prevented from moving laterally relatively to the button, by the sides of the profiled groove in abutment with the button.

Figure 2:
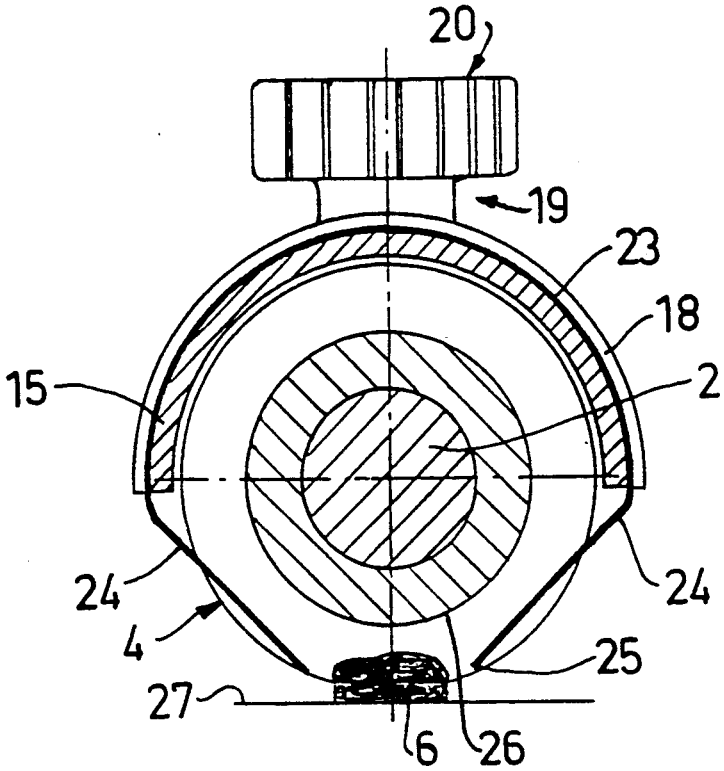
FIG. 2 is a sectional view taken substantially on the line II—II in FIG. 1.
Figure 3:
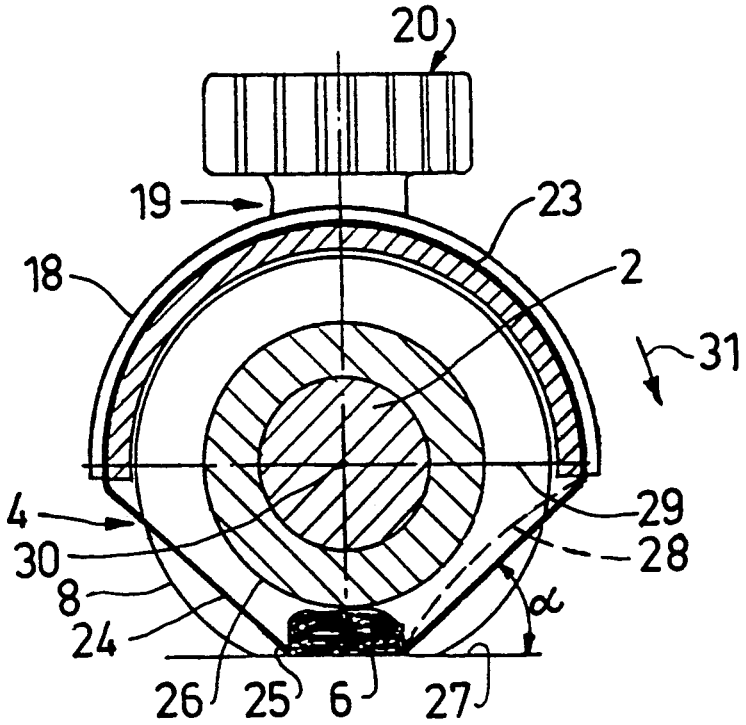
FIG. 3 is a view similar to the view of FIG. 2, but with the grinding disk in engagement with a button to be ground.

FIGS. 2 and 3 illustrate the grinding machine in parallel abutment with the button 4, i.e. the plane 29 of the grinding machine is parallel with the end surface 27 of the button drill-bit. However, because of their elasticity or springiness, the fingers 24 will also permit the grinding machine to be rotated about the rotational axis 30 of the machine spindle, in one direction or the other. For instance, if the grinding machine is rotated in the direction of the arrow 31 in FIG. 3, one finger 25 is caused to bend automatically outwards or inwards, as shown by the broken line 28, or, if the finger was already bent outwards or inwards, to be bent further outwards or inwards, and, as a result of its curvature, the finger will constantly increase the force required to rotate the machine, wherewith the operator obtains direct signals as to how the machine is held. The other finger 24 on the other side will straighten out and spring back.

It will be understood that the present invention is not restricted to the aforedescribed and illustrated embodiments thereof, and that modifications can be made within the scope of the inventive concept as defined in the following Claims. For instance, the keeper 18 may be detachable or fixably connected to a protective shield which at least partly covers the grinding disk 4. Furthermore, the finger ends 25 need not have the illustrated convex, arcuate end-profile, but may instead be straight, substantially straight or have a concave, arcuate end-profile. With regard to the aforesaid forces that occur, it will be understood that these forces are, to some extent, dependent on the frictional forces occurring between the grinding disk and button during a grinding operation, and that the direction of these forces is dependent on the direction of rotation of the grinding disk.

I claim:

1. A grinding guide assembly for a hand-held grinding machine having a body from which a rotary spindle projects, rotates about its own longitudinal axis and mounts a grinding disk having a radially outwardly opening groove that is generally U-shaped in longitudinal cross-section and flanked by two axially opposite radially outwardly facing shoulders, for receiving in said groove between said shoulders as said grinding disk rotates, and said body is hand-held, a respective generally hemispherical button having an outer perimeter of a given diameter, which button protrudes from a surface of a button drill bit body, said grinding guide comprising:

a cover for an upper side of the grinding machine;

means for securing the cover to the body of the grinding machine so that a portion of the cover extends into radially spaced, radial adjacency with the generally U-shaped groove in the grinding disk mounted to the spindle of the grinding machine on one side of the longitudinal axis of the spindle;

a guide spring means having a central portion and two angularly opposite finger-like end portions based on said central portion and having respective free ends; and locking means securing said central portion of said guide spring means to said cover, so that said end portions of said guide spring means extend past said axis and said free ends project towards one another from angularly opposite directions and are disposed to engage the outer periphery of the button at two respective diametrically opposite sites.

2. The grinding guide assembly of claim 1, wherein:

said finger-like end portions of said guide spring means are so extensive, transversally of said axis, that as the groove of the grinding disk is being moved towards grinding engagement with a respective button, the free ends of the finger-like end portions of the guide spring means must first engage the surface of the button drill bit body, and the spring end portions flex so as to bring the free ends thereof into engagement with said diametrically opposed sites on said outer periphery of the respective button before said groove of the grinding disk can grindingly engage the respective button.

3. The grinding guide assembly of claim 1, wherein:

said locking means removably secures said guide spring means to said cover.

4. The grinding guide assembly of claim 3, wherein:

said guide spring means is constituted by an integral generally C-shaped spring having said free ends at angularly opposite ends thereof.

5. The grinding guide assembly of claim 4, wherein:

said means for securing the cover to the body of the grinding machine are arranged for removably securing the cover to the body of the grinding machine.

6. The grinding guide assembly of claim 1, wherein:

said finger-like end portions of said guide spring means taper in extensiveness along said axis as they extend from said central portion towards respective ones of said free ends.

* * * * *